United States Patent [19]

Brumlik

[11] 4,198,459

[45] Apr. 15, 1980

[54] FILAMENTS WITH EVOLVED STRUCTURE AND PROCESS OF MAKING SOME

[76] Inventor: George C. Brumlik, 154 Upper Mountain Ave., Montclair, N.J. 07042

[21] Appl. No.: 829,375

[22] Filed: Aug. 31, 1977

Related U.S. Application Data

[63] Continuation of Ser. No. 747,085, Dec. 3, 1976, abandoned.

[51] Int. Cl.[2] ..... D02G 3/00

[52] U.S. Cl. ..... 428/224; 428/359; 428/362; 428/364; 428/369; 428/371; 428/373; 428/398; 428/399; 428/400

[58] Field of Search ..... 428/373, 374, 400, 398, 428/399, 364, 357, 359, 362, 369, 370, 371; 57/140 J, 140 BY, 140 R, 243, 244, 245, 246, 252, 254

[56] References Cited

U.S. PATENT DOCUMENTS

| | | | |
|---|---|---|---|
| 3,069,747 | 12/1962 | Adams | 428/398 |
| 3,185,613 | 5/1965 | Adams | 428/399 |
| 3,500,627 | 3/1970 | Kim | 57/140 J |
| 3,522,637 | 8/1970 | Brumlik | 57/140 J |
| 3,691,748 | 9/1972 | Buzano | 57/140 J |
| 3,857,230 | 12/1974 | Rasmussen | 57/140 J |
| 3,922,329 | 11/1975 | Kim et al. | 264/147 |
| 3,922,455 | 11/1975 | Brumlik | 428/372 |
| 3,986,331 | 10/1976 | Brumlik | 428/398 |

*Primary Examiner*—Lorraine T. Kendell

*Attorney, Agent, or Firm*—Sprung, Felfe, Horn, Lynch & Kramer

[57] ABSTRACT

A textile multi-filament yarn having individual filaments cohered together at least in part by individual interfilamentary bridges, which bridges are disposed within the multi-filament yarn to join the filaments thereof so as to render the yarn structurally frozen so that at least a part of the individual filaments cannot be pulled apart without breaking at least in part the structure of the multi-filament yarn. The bridges are made of the same material as the filaments. Some of the segments of individual filaments between consecutive interfilamentary bridges can be of different length.

18 Claims, 17 Drawing Figures

FILAMENTS WITH EVOLVED STRUCTURE AND PROCESS OF MAKING SOME

This is a continuation, of application Ser. No. 747,085, filed Dec. 3, 1976, now abandoned.

BACKGROUND

Man-made synthetic polymer yarns have been hitherto comprised of filaments and fibers of an essentially smooth and constant diameter. The filaments and fibers of prior art are essentially uniform and lack transverse stripes or closely spaced short thicker and thinner segments characterized by crests and troughs. Know textile filaments and fibers, man-made of synthetic material for use in yarns and fabrics, lack further a structure consisting of sequences of short and closely spaced segments which are physically and chemically different from the remainder of the filamental trunk. This lack of structural detail in the filaments and yarns of prior art limits the usefulness and variety of the present day fabrics made from the same. The commercial nonwoven fabrics, in particular, are made with a binder which renders such fabrics stiff and unappealing to the touch and to the eye. The current texturing processes are also considerably slower compared to the speed at which synthetic yarns are spun or otherwise produced.

The object of the present invention is to provide a textile filament of synthetic man-made material characterized by a new refined transverse and longitudinal structure. Another object of this invention is to provide a method affording a greater control over the uniformity as well as variation of the structure of the produced filaments. A further object of the present invention is to provide a method for the structuring and technique of synthetic filaments and yarns which is subject to computer control.

Another object of the invention is to provide a method affording structuring and texturing rates commensurate to the highest rates at which the filaments can be produced. Another object of the invention is to provide textile yarns of synthetic material which have structural integrity even in absence of twist—such yarns comprise both monofilament yarns and staple yarns.

Another object of the present invention is to provide a new high speed method for heating of yarn that lends itself to control by a computer loop. This method comprises advancing the yarn longitudinally and exposing said yarn to a sequence of fast plasma bursts delivered from a plasma burst applicator positioned in the vicinity of the yarn. A microwave cavity is an excellent means to serve as the said plasma burst applicator.

The plasma bursts heat the yarn in closely spaced sequences in the space-time frame. These sequencies can be phased in such a manner so as to heat either a fraction- or the total whole of the treated yarn. The present method of heating of this invention differs from the method of prior art in the discontinuous manner in which the quanta of energy are coupled to the moving yarn, in the rapid rise time and fall time of each said quantum of energy, in the extremely rapid sequence in which the said quanta are pulsed, and in the ability of controling the energy content, the duration, and time-profile characteristics of individual pulses and their combination in the trains of their sequences.

SUMMARY

The present invention relates to synthetic material textile filaments and yarns with a highly refined structure, and to the method for making the same. The filaments of the present invention are characterized by a closed spaced sequence or sequences of integrally joined short filamental regions or segments which differ from one another or from the structural and internal properties of the original filament. Among the differences in properties of the said short segments may be: degree of molecular orientation, density, refractive index, diameter, physical shape, moisture absorbency, propensity to take up dye, tensile strength, modulus of elasticity, stiffness, toughness, and other mechanical properties, optical properties, dielectric and magnetic properties, surface structure and appearance. The above enumerated variations in properties affect the characteristics of yarns and fabrics made therefrom. Among such characteristics of the said fabrics are: hand, drape, body, appearance, pliability, softness, wearing comfort, resilience, lustre, sheen, tactile touch, scroop, coherence, strength, provisions for loft and bulk, wrinkle resistance, press retention, reduction of pilling, insulation qualities, moisture absorbency and ability of fabric to be fulled and teaseled to raise nap. The filaments of the present invention feature sequencies of crests, troughs, nibs, beads and necks all of which constitute microscopic detents. Such detents interlock with one another on contact and fasten together with elements of texture such as bends, kinks, loops, crimps, helix segments, and eyes of net-like filaments. This interlocking property of the fibers of the present invention makes them valuable as components of non-woven materials and fabrics. The new nonwoven materials, comprising filaments of the present invention, can be made without a binder. The said nonwoven fabrics are held together by means of the interlocking of the here described filamental detents.

The materials of the filaments of the present invention include man-made polymers such as polyesters, polyamides, polyimides, polyolefins, celulose based polymers, polysulfones, polyurethanes, polyureas, polyvinyl derivatives, chlorinated and fluorinated polyolefins, elastomers, block and graft polymers, polyphenylene oxide and sulfide, polyacetals epoxide based polymers, copolymers and the like. Inorganic man-made substances may serve as materials of construction. Graphite based fibers of the present invention are produced by pyrolysis of their precursors made from organic synthetic polymers. The method of the present invention affords structured filaments of the present invention made from man-made glasses including silicate, boro-silicate (Pyrex) and alumino-silicate glasses. The preferred method for the production of said yarns comprises means for moving the yarns or filaments longitudinally and exposing the moving yarns to an ultra-rapid and controllable sequence of plasma bursts. According to our best knowledge, there is no prior art describing fibers, yarns and the method of the present invention. The yarn employed in the said treatment may be non-oriented, partially oriented or fully oriented. The orientation is obtained, for example, by drawing, twisting, or combined drawing and twisting. The attained properties and structure of the filamental segments arising on treatment with bursts of plasma differ in character depending on the type, and degree of moleclar orientation of the original yarn. Beads of diameter larger than the diameter of the parent filaments are formed under the action of the plasma bursts in yarn that has been previously oriented by drawing or the like. When present in a yarn, the filamental beads may form interfilamental bridges giving the said yarn a coherence; such a yarn may be left in an untwisted form. The plasma bursts may sever individual filaments of a yarn in a staggered manner providing a direct method for the production of staple yarn from a yarn originally composed of monofilaments.

In addition to the production of beaded structure, and the formation of interfilamental bridges in yarns, characteristic moieties of change may be present in the filaments of the present invention. These moieties of change include visible and latent characteristics. The latent moieties of change are present sequentially along the length of the filaments of this invention and produce characteristic variation in structure of the said filament on exposure to heat, steam, or the action of chemical agents. Among the structural changes are the formation of: bends, kinks, loops, coils, beads and necked down regions which may be present in many combinations and sequences. In the present invention, such variation of the segment properties and their arrangement in combinations in their sequences along the length of the filaments in the yarn may be controled in a predetermined manner.

The present invention both as to the new filaments, yarns and products formed therefrom, together with the method of production thereof, will be best understood when read in the connection with the accompanying drawings.

DETAILED DESCRIPTION

Yarns and filamental products can be modified by a continuous operation as illustrated in FIGS. 1 to 4. In the interpretation of the said first four figures, the term yarn is used generically to describe monofilaments, bundles of filaments, sliver, continuous filament yarn—both twisted and untwisted, staple yarn, and other yarn. The yarn can have any structure, crossection or profile and comprises synthetic filaments, or organic or inorganic filaments and fibers.

The yarn can be composed of a single material or a mixture of materials. Such a mixture can comprise man-made materials blended together with natural fibers. The fibers can have any crossection and can be simple, bicomponent, biconstituent, and may consist in whole or in part of metal.

Figure 1:
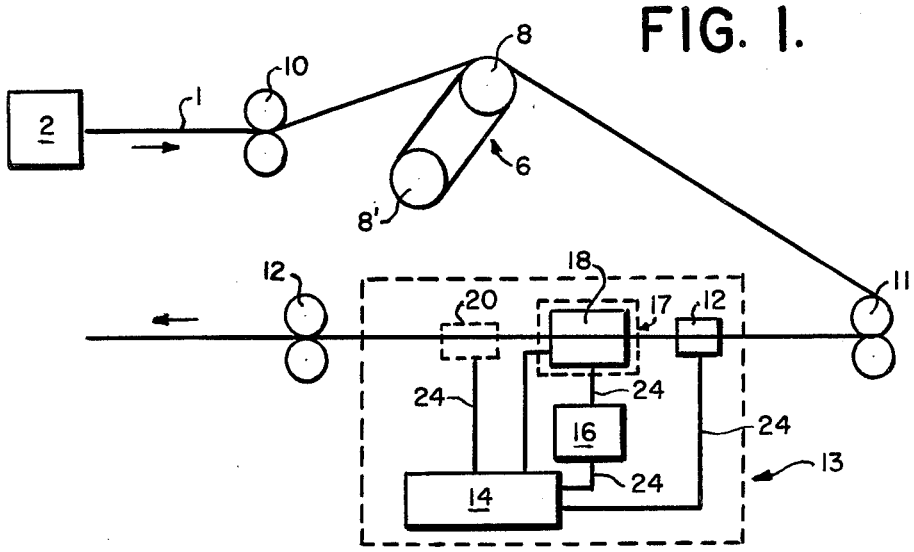
FIG. 1 is a schematic representation. The process and apparatus for treating of yarn to provide products of the present invention.
Figure 2:
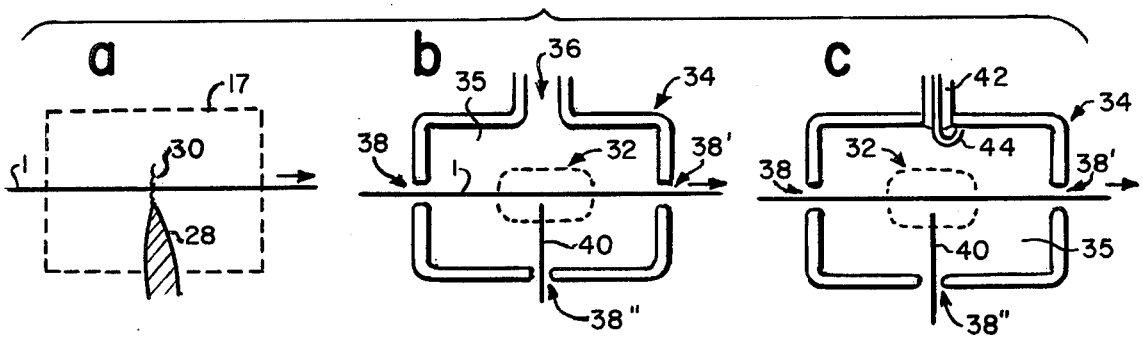
FIG. 2*a* to *c* are cross-sectional representations of yarn forming applicators in which the rapidly moving yarn is subject to plasma bursts.
Figure 3:
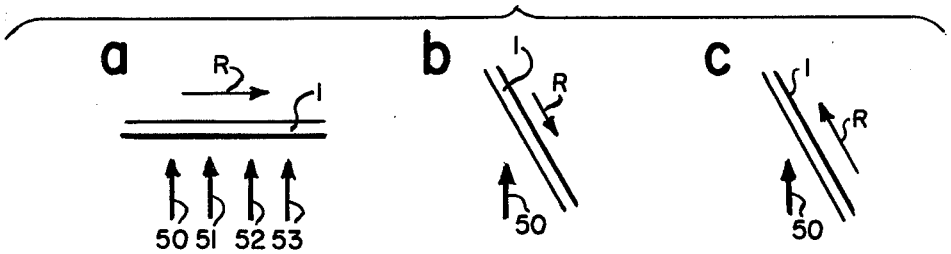
FIGS. 3*a* to *c* are cross-sectional representation of the relative linear and angular vector positions of the plasma burst and the longitudinally progressing yarn.
Figure 4:
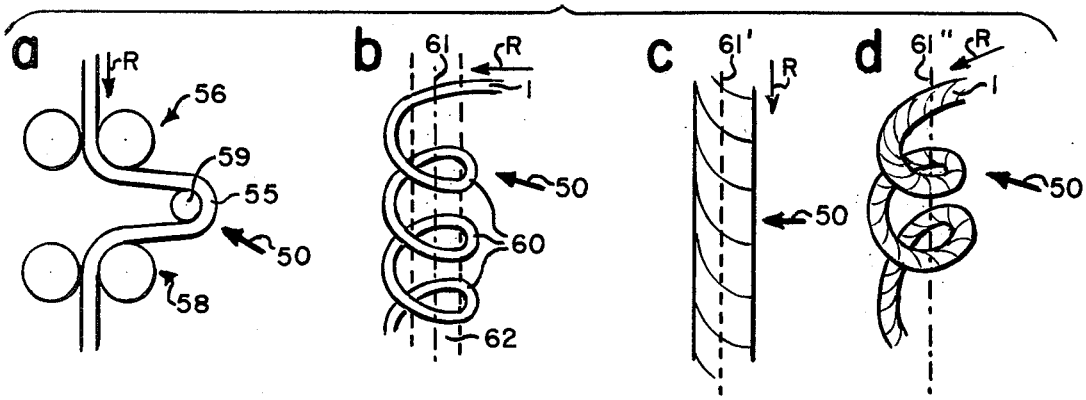
FIGS. 4*a* to *d* are cross-sectional representations of bent, coiled, twisted, twisted and coiled yarn progressing in an overall longitudinal direction and simultaneously subjected to a rapid sequence of plasma bursts.

Referring now to the drawings. In FIG. 1, the yarn 1 is advanced from the yarn source 2 and fed to the drawing stage 6, then through the operation and control loop 13 by sequence of nip rolls 10, 11, and 12. The drawing stage 6 is omitted either in case where non-oriented yarn is processed or where pre-oriented yarn is obtained from the yarn source 2. The advancing yarn 1 enters the drawing stage 6 comprising a set of drawing rolls 8 and 8' where it is molecularly oriented, from there it is fed by nip rolls 11 to the operation loop 13. The advancing yarn enters a twisting station 12 where it is twisted. The twisting station 12 is an optional part of the method of the present invention. The yarn 1 then advances through the working area 17 comprising the plasma burst applicator 18 where it undergoes structural modification. The form and function of the plasma burst applicator 18 is described in greater detail in conjunction with FIGS. 2, 3, 4, and 6. The plasma bursts are applied at a rate ranging from 1 kiloHerz to 10 megaHerz. Numeral 16 represents a power supply for the plasma burst applicator 18. The yarn structured in the working area 17 is monitored by sensor means 20 which is preferably a vidicon-or an image dissector tube camera connected to a computer control 14 interconnected by communication channels 24 to the plasma burst applicator 16 and its power supply 16 as well as to the optional twisting station 12.

The structured yarn is fed by the nip rolls 12 to the wind up station (not shown). The nip rolls 11 and 12 travel at controllable speeds and the yarn can enter the process and control loop 13 under any desired degree of tension or slack. This means that the processed yarn can be overfed or stretched during any phase of the processing sequence.

Figure 6:
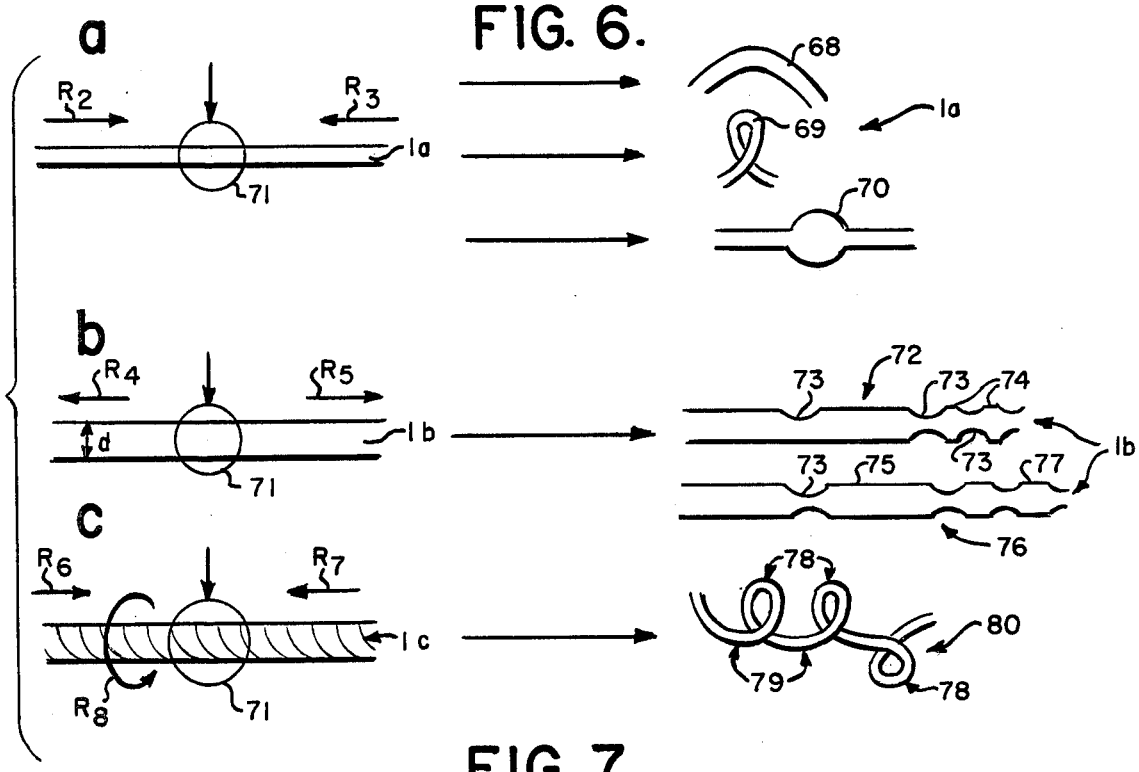
FIGS. 6*a* to *c* are cross-sectional representations of plasma burst treated filaments. The figures illustrate characteristic changes brought about in oriented and non-oriented filaments when treated in tensed or relaxed modes.

FIG. 6 illustrates in greater detail the changes in the filament 1 occurring in the plasma burst structuring of filaments of the present invention as they depend on the previous history of filament manufacture and the degree of tension or slack.

FIG. 6*a* represents a textile filament 1*a* that has been molecularly oriented by drawing and that is treated with plasma bursts while relaxed—shown by arrows $R_1$ and $R_2$. Among the characteristic changes occurring under such conditions are the formation of a bend 68, loop 69, and bead 70 along the length of the filament 1*a*. A given particular change depends on the relative vector positions and movement of the filament 1 and the plasma burst streamers 50 to 53 as shown in FIGS. 3*a* to *c*, and FIGS. 4*a* to *d*.

FIG. 6*b* illustrates the changes occurring in a tensed filament. The streamer of the plasma burst softens the filament 1*b* in the area of plasma-filament interaction 71 which due to tension yields to give constricted troughs 73, leaving the normal diameter of the filament d to define the thicker areas 70 in the fibers 1*b*'. Beads 74 are formed when troughs 73 are spaced close together.

FIG. 6*c* represents a textile filament 1*c* pre-oriented by twisting of drawing and twisting. The filament 1*c* can be oriented individually or simultaneously with other filaments in a multifilament yarn. Filament 1*c* coils on exposure to a sequence of plasma bursts to give a highly textured filament 80 having loops 78 and bends 79.

FIGS. 2*a* to *c* are crossectional representations of plasma burst applicators of the present invention. FIG. a is a schematic representation of the working area enclosing the moving yarn 1 and comprising a pointed applicator 28 delivering bursts of plasma 30 which can be in form of sparks or other plasma phenomena of short-duration. According to the present invention, the sequence of the plasma bursts of the present invention has a repetition rate of 0.1 kiloHerz to 10 megaHerz and the yarn is advanced at speeds ranging from 10 yards per minute to 6 thousand yards per minute.

FIG. 2*b* is a crossectional representation of an applicator in form of a microwave cavity 34 having openings 38 and 38' to permit the passage of the yarn 1 through the working area 32 containing plasma at least at intermittent intervals. Plasma bursts are produced by microwave power pulses which break down the fluid 35 contained in the microwave applicator or by electrical pulses produced by the probe 40 causing a dielectric breakdown to which the microwave field instantly couples. The pulses are produced by the power supply 16 in FIG. 1 which can include a pulser for the microwave cavity 34 as well as a separate pulser for the probe 40. Probe 40 may be a solid electrical conductor or may be in form of a plasma streamer conductor produced externally and introduced through an opening 38".

Numeral 36 is a crossectional representation of a wave guide through which microwave power is coupled to the microwave applicator 34. Numeral 42 is a crossectional representation of a coaxial cable coupled to the microwave applicator 34 as shown in FIG. 2*c* which in all other respects is similar to FIG. 2*b*.

FIGS. 3*a* to *c* are vectorial representations of the relative positions of the plasma burst directions 50 to 53 and the direction of the advancing filament 1 represented by arrow R. The vector relationships are important elements of control over the properties of structure and texture of the produced yarns.

FIGS. 4*a* to *c* are further representations of the relative positions and forms of yarn 1 with respect to the direction of the applied plasma burst 50. FIG. 4*a* illustrates yarn 1 contacted by the plasma burst 50 at the site of a loop 55 formed between two nip rolls 56 and 58. The loop 55 may form with or without the aid of a pin 59. FIG. 4*b* illustrates filament 1 in the form of a helix treated with plasma bursts 50 transversely positioned with respect to the axis 61 of the helix. FIG. 4*c* illustrates a twisted yarn exposed to plasma bursts in a transverse direction to the axis 61 of the said twist. FIG. 4*d* is a three-dimensional representation of a yarn 1 that has been both twisted and then coiled around the axis 61"exposed to plasma bursts 50 oriented from a transverse direction.

Figure 5:
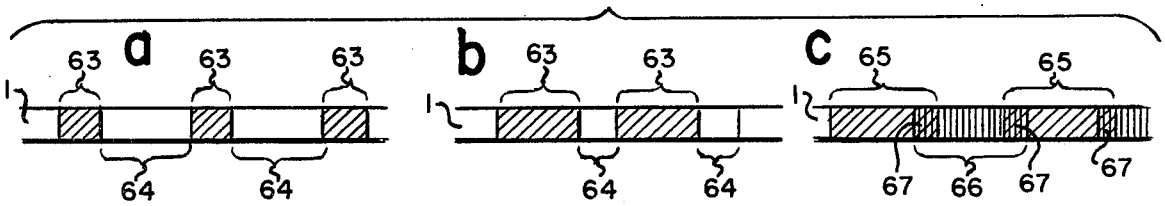
FIGS. 5*a* to *c* are cross-sectional representation of segments of yarn showing the plasma burst treated portions and the untreated portions of the yarn.

FIGS. 5*a* to 5*c* are crossectional representations of sections of filament 1 after heat treatment with a sequence of plasma bursts. The treated portions with properties modified by the encounter with plasma streamers are shown in shaded form.

FIG. 5*a* is a representation of a section of filament or yarn where the heat treated segments 63 are shorter than the untreated sections of the filamental trunk 64; this form of filament is obtained with a duty cycle of plasma burst treatment of the filament of less than 50%. FIG. 5*b* is a crossectional representation of a section of filament with treated portions 63 (shaded areas) larger than the untreated segment 64; this second form of filament is obtained with a cuty cycle of plasma burst treatment larger than 50%. FIG. 5*c* is a crossectional representation of a filament section heat treated with plasma burst from two or more applicators whose sum of duty cycles is more than 100% so that the slant-line shaded segments 65 overlaps with the vertical-line segments 66 to form doubly exposed areas 67 (cross hatches). The total of the filament represented by FIG. 5*c* has been heat treated in this manner. The filament segements in FIGS. 5*a* to *c* are shown without crossectional changes in structure. Such changes in crossection are minimized by keeping the filament in tension during the said treatment.

The obtained physical and chemical changes from the original properties of the yarn produce latent characteristics which are brought out as geometrical changes in structure by the exposure of the said filaments (represented by FIGS. 5*a* to *c*) to the action of heat, drawing, twisting, steam, aging, and other physical agents as well as by chemical reagents.

Figure 7:
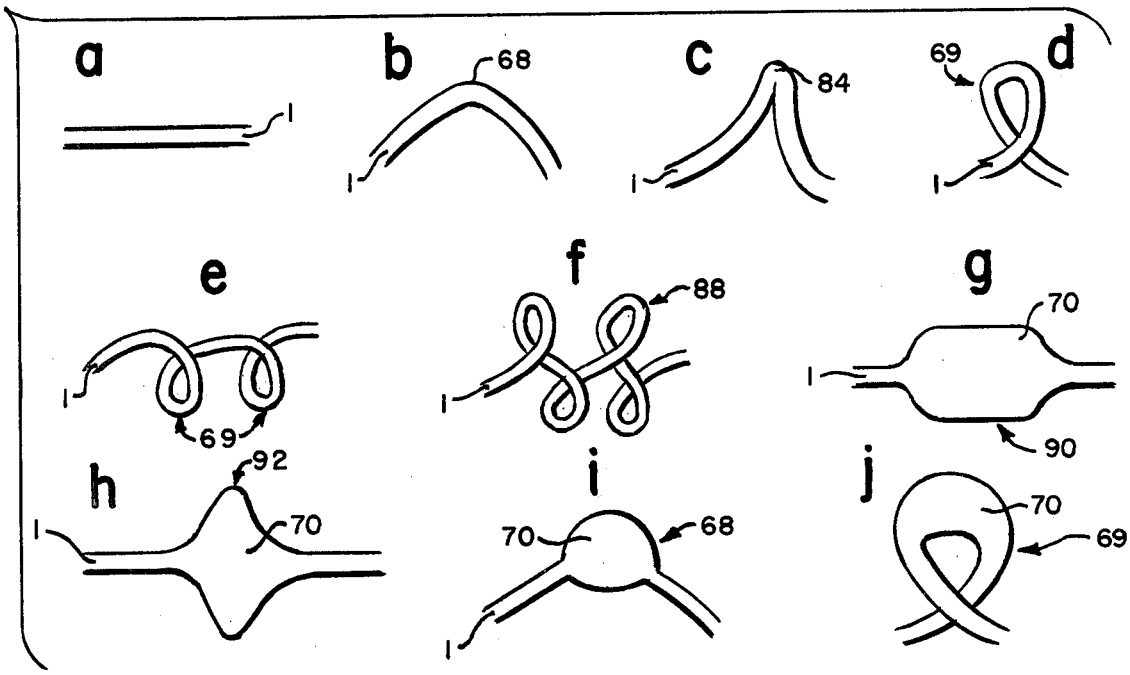
FIGS. 7*a* to *m* are cross-sectional representations of structural changes produced in filaments treated with plasma bursts.
Figure 7:
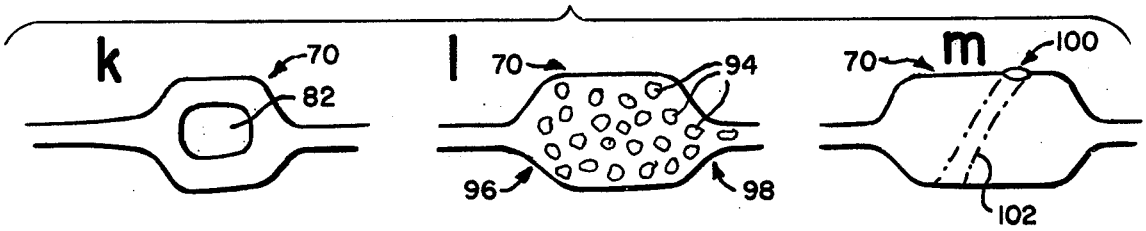

FIGS. 7*a* to m are characteristic change types obtained in the filament 1 on exposure to plasma bursts. These changes comprise the following units as represented in crossection in the listed figures in filament 1:

FIG. 7*a*—no change; FIG. 7*b* shows bend 68, FIG. 7*c* shows kink 84; FIG. 7*d* shows loop 69; FIG. 7*e* shows coil; FIG. 7*f* shows reversed coil; FIG. 7*g* shows elongated bead or nodule 70 having a flat portion 90; FIG. 7*h* shows short bead 70 having a crest 92; FIG. 7*i* shows bend 68 with a bead or nodule 70 as a part of the said bend; FIG. 7*j* shows bend 69 with bead or nodule 70 as a part of the said bend; FIG. 7*k* shows a bead 70 containing a cavity 82 within the said bead; FIG. 7*l* shows a bead 70 comprising a multitude of cavities 94 filling the bead with a foam structure. The foam is produced with particular facility in filaments containing a blowing agent from the classes azodicarbonamide and its modified derivatives, high temperature blowing agents for example (HTBAs), chemical blowing agents (CBAs), Lucil Azo CBAs, Stepan's 5PT Expandex 150 and 175, Uniroyal's Celogen HT-550, General Electric Lexan FL-C95. The plasma streamers can heat the filament material for periods of miliseconds to monoseconds to a temperature higher than the spinning temperature and thereby cause the formation of gas filled bubbles or other cavities and voids. The bead of FIG. 7 is of low symmetry having side 98 and 96 differing in slope.

FIG. 7*m* shows a bead with a pore 102 existing at the opening 100; treated filaments of this invention may have multitudes of pores present in either or all filamental structures such as beads, necked down regions, bends, coils, and other segments of the formed filaments.

When a multifilament yarn is exposed to the method of structuring and texturing of the present invention, some formed filamental beads join filaments that are positioned close together by means of interfilamental bridges. Such a yarn may be composed of monofilaments or staple fibers and may be twisted or untwisted in its original or resultant forms.

Figure 8:
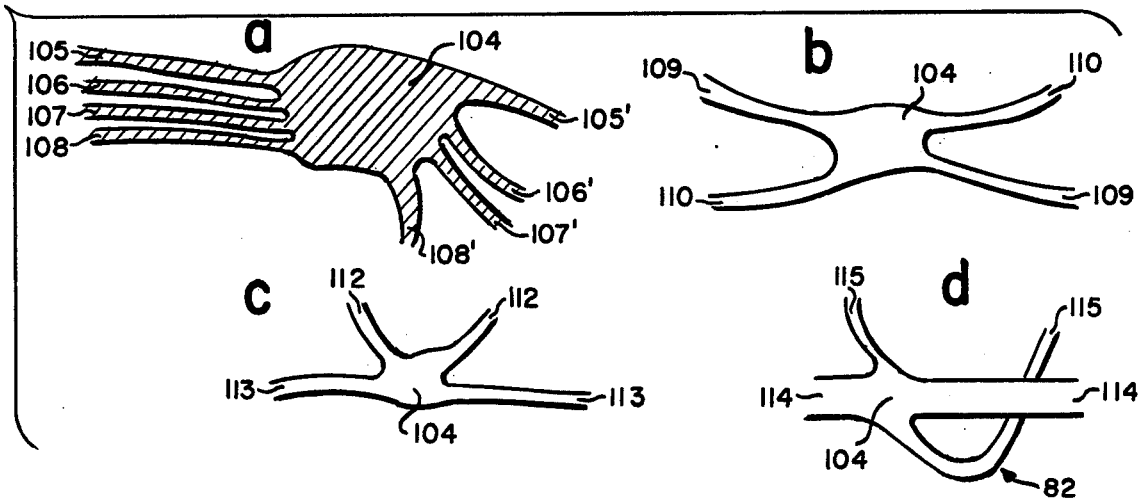
FIGS. 8*a* to *d* are cross-sectional representations of interfilamental bridges formed between adjacent filaments of a yarn on treating the same with plasma bursts.

FIGS. 8*a* to *d* illustrate common forms of interfilamental bridges formed by means of the applied method of the present invention. Four individual filaments 105 to 108 are joined by a common interfilamental bridge 104 and at the same time experience a change of their original direction as shown in FIG. 8*a*. Two filaments 109 and 110 form an interfilamental bridge 104 at their point of crossing (FIG. 8*b*). FIG. 8*c* illustrates the formation of an interfilamental bridge 104 between a bent filament 112 and straight filament 113 formed at a point of contact. A similar interfilamental bridge 104 is formed between a thin bent filament 115 and a relatively thicker straight filament 114 at one point of their two crossings.

Figure 9:
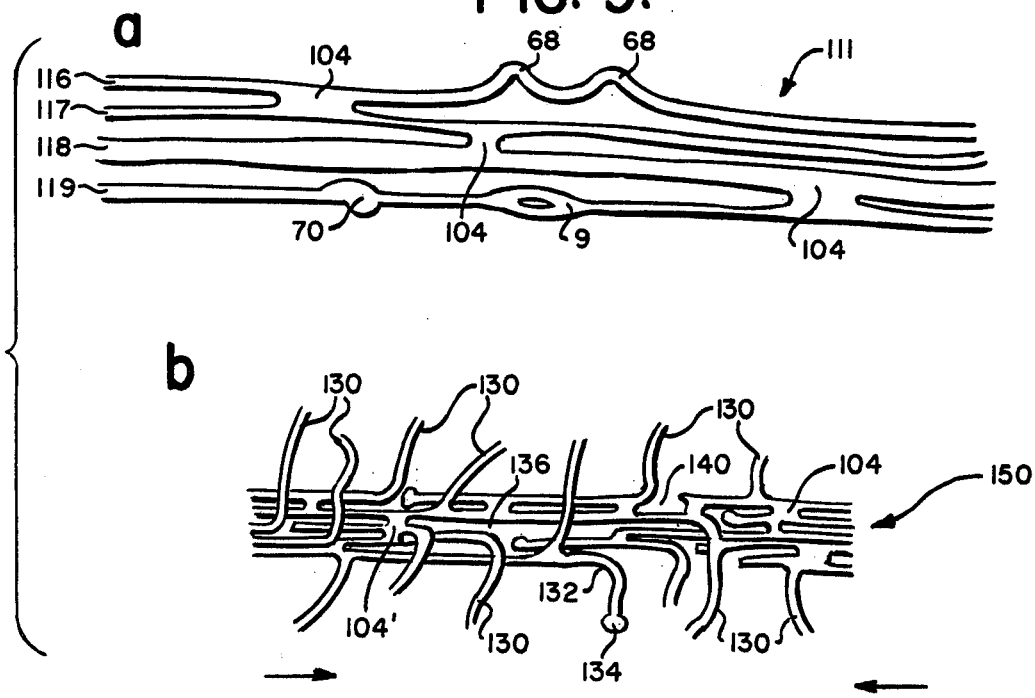
FIG. 9*a* is a cross-sectional representation of a yarn with consistent filaments joined with interfilamental bridges.
FIG. 9*b* is a cross-sectional representation of a staple yarn formed from an originally monofilament yarn by severing of the monofilament constituents of the originally monofilament yarn with plasma bursts.

FIG. 9*a* is a crossectional representation of a yarn 111 consisting originally of parallel straight filaments and treated by the method of the present invention. The said yarn is coherent due to its interfilamental bridges 104 and it is textured with wavy structure 68 and structured with beads 70. FIG. 9*b* is a crossectional representation of a staple yarn formed from a monofilament yarn comprising a number of filaments by treatment with a sequence of plasma bursts according to the present invention and by compressing the resultant yarn as shown by arrows. The plasma bursts form interfilamental bridges 140 which bind the yarn together and at the same time sever some of the monofilaments producing a multitude of free ends 130 some of which escape the main trunk of the yarn and may take a transverse conformation. The free ends may terminate in a thickened end 134.

Figure 10:
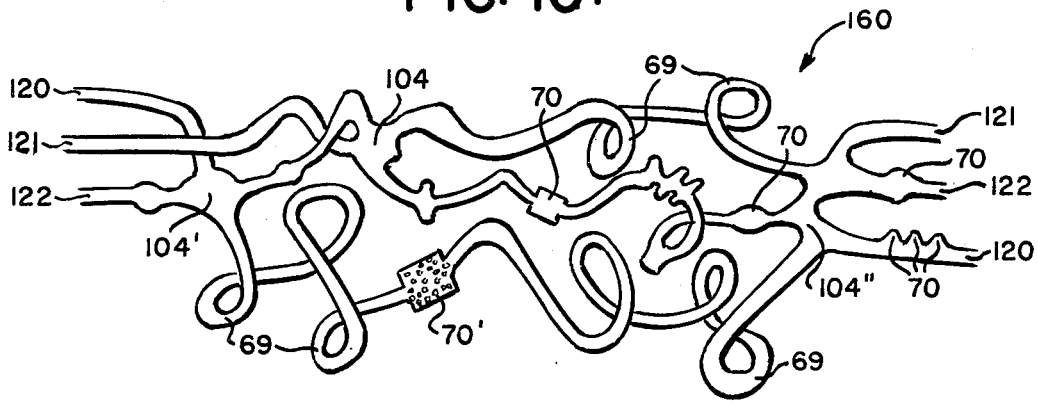
FIG. 10 is a cross-sectional representation of a yarn comprising structured filaments of the present invention joined into a yarn structure by interfilamental bridges.

FIG. 10 is a crossectional representation of more complex yarn 160 formed from monofilaments 120, 121, and 122 which cross one another and are joined into an integral whole by interfilament bridges 104, 104' and 104''. The filament 120 is longer than in the other two filaments and has a rich structure (having six loops 69) which is frozen in and cannot be pulled out due to the two bridges 104' and 104'' which connect the long helical filament 120 to the other two shorter filaments 121 and 122. The ability to freeze in texture-characteristics is a unique feature of yarns with interfilamental bridges of this invention. Bead and nodule structure 70 and 70' are also represented in FIG. 10.

Figure 11:
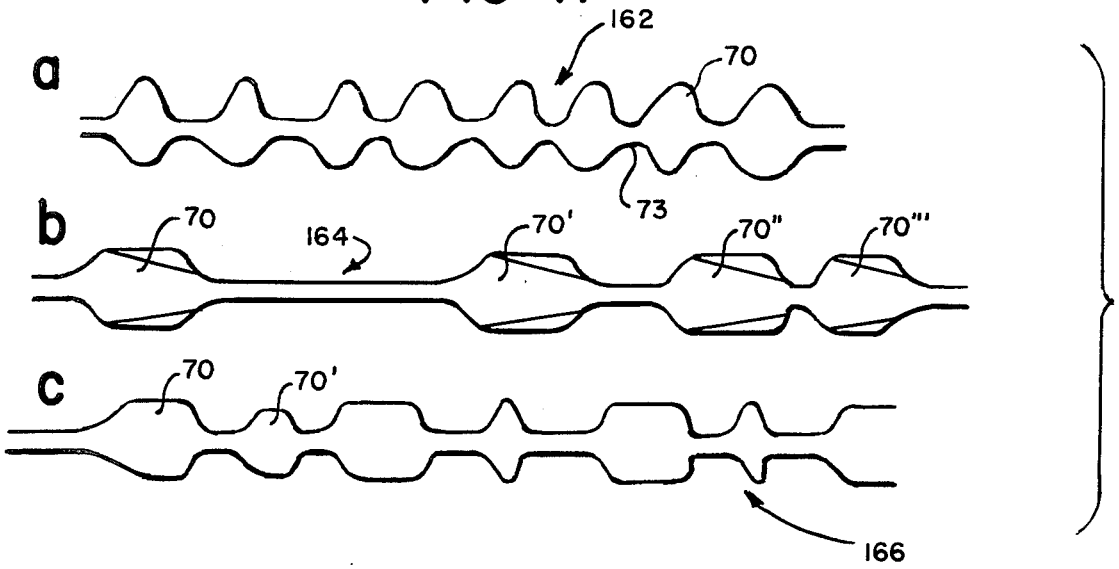
FIG. 11*a* to *c* are cross-sectional representations of beaded filaments of the present invention.

FIGS. 11*a* to *c* is a crossectional representation of filaments featuring beads of the present invention. Filament 162 of FIG. 11*a* has a regular structure comprising evenly spaced beads 70 of equal size. Filament 164 of FIG. 11*b* has unequally spaced beads 70, 70', 70'' of equal geometry. Filament 166 of FIG. 11*c* has equally spaced beads or nodules 70 and 71' of different geometries. The term nodule is used to emphasize that the thickend portion of the filaments 70 may lack a cylindrical symmetry which sometimes is associated with the concept of a "bead."

Figure 12:
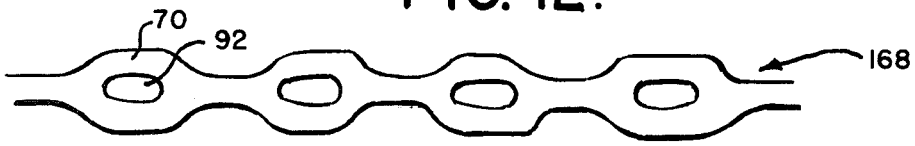
FIG. 12 is a cross-sectional representation of a beaded filament of the present invention having hollow beads.

FIG. 12 is a crossectional representation of a filament 168 featuring beads with cavitites 92. Such cavities may be closed or open to the outside.

Figure 13:
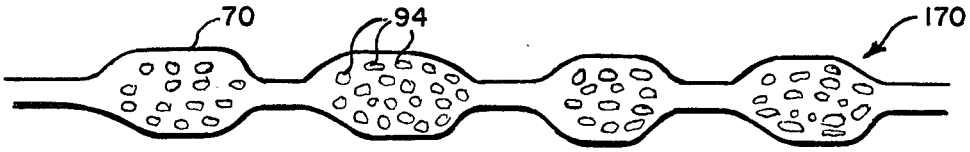
FIG. 13 is a cross-sectional representation of a filament whose beads contain a multitude of bubbles.

FIG. 13 is a crossectional representation of a filament 170 of the present invention having a multitude of cavities 94 in its beads 70 characterizing beads filled with foam.

Figure 14:
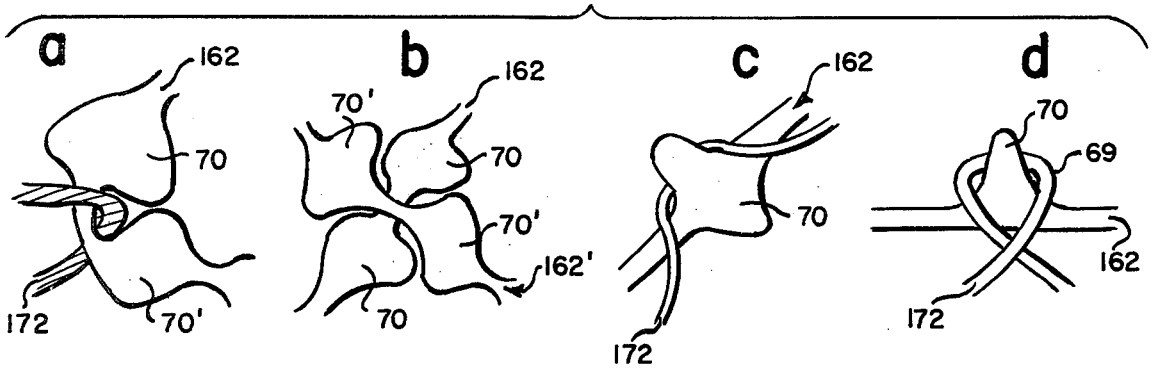
FIG. 14*a* to *d* are cross-sectional representations of beaded filaments in detent engagement with other beaded or smooth filaments.

FIG. 14*a* to *d* shows elements of interlocking between filaments with nodules in mutual fastening and in fastening with smooth filaments. FIG. 14*a* illustrates a fastening position of a smooth filament 172 wedged between two nodules 70 of the filament 162. FIG. 14*b* illustrates the interlocking of nodules 70 and 70' of two individual filaments 162 and 162' at their necked down sites between the said nodes 70 and 70'. FIG. 14*c* shows a thin smooth filament 172 in engagement with the node of a thicker filament 162. FIG. 14*c* depicts a thin filament 172 fastened by means of a loop around a nib shaped nodle 70 of the filament 162.

Figure 15:
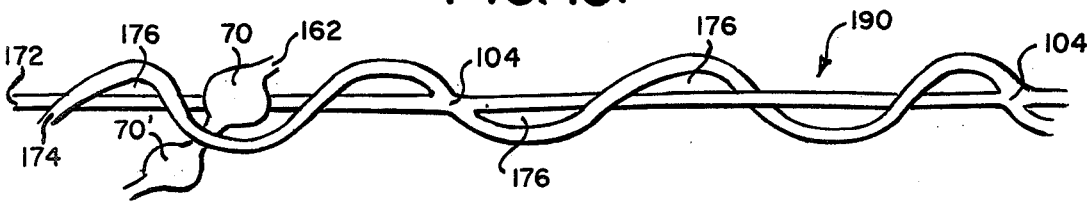
FIG. 15 is a cross-sectional representation of a wavy filament bonded to an essentially straight filament to form a composite filament having a multiplicity of loops; the second loop (left to right) is shown to engage a beaded filament.

FIG. 15 illustrates how the wavy texture of the filament 174 is locked or "frozen in" by means of interfilamental bridges 104 which join the wavy filament 174 to a straight filament 172. The loops formed between the said two filaments serve as detents capable of holding and fastening beaded filaments such as filament 162 whose bead 70 has been entrained by the loop 176.

Figure 16:
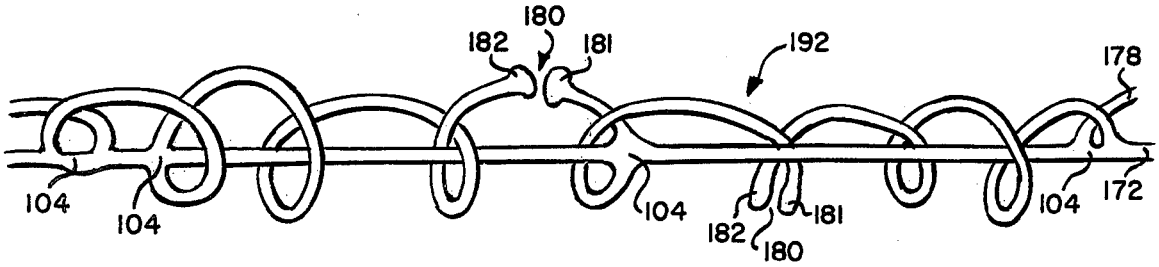
FIG. 16 is cross-sectional representation of a helical filament bonded to an essentially straight filament depicting structural means for the transformation of monofilament yarn to a staple yarn by introducing cuts into the said helical filament.

FIG. 16 is a crossectional representation of composite structure 192 comprising a helical filament 178 joined to a straight filament 172 by means of interfilamental bridges 104. FIG. 16 illustrates that the joint structure cannot be pulled straight despite the interruption of the helical filament at sites 180 where the helical filament has been severed. The ends 181 and 182 are characteristically rounded.

Figure 17:
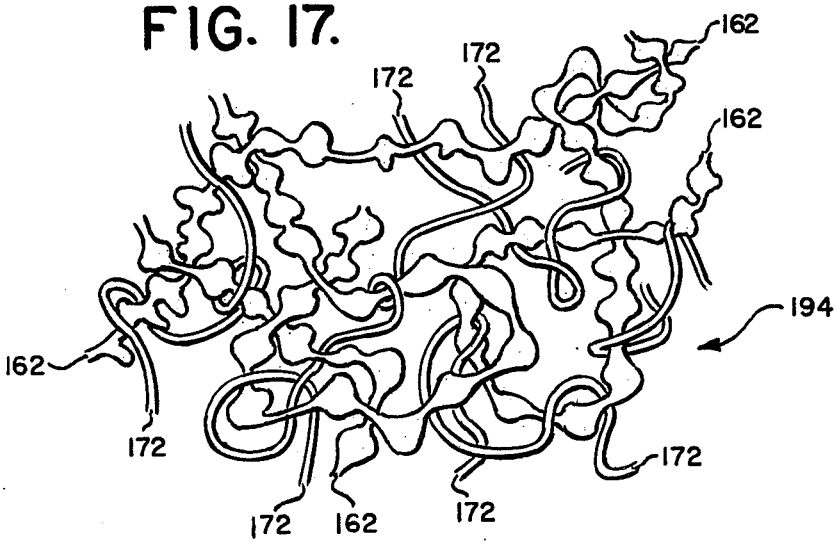
FIG. 17 is a cross-sectional representation of a nonwoven fabric comprised of beaded filaments and smooth filaments.

FIG. 17 is a representation of a portion of a nonwoven fabric 194 comprising at least in part filaments 162 of the present invention and smooth filaments 172. FIG. 17 illustrates the coherence of the structure of the nonwoven fabric 194, which maintains its integrity without an adhesive binder.

What is claimed is:

1. A textile multi-filament yarn comprising individual filaments cohered together at least in part by individual interfilamentary bridges, said interfilamentary bridges being disposed within said multi-filament yarn and joining the filaments thereof so as to render the yarn structurally frozen so that at least a part of the individual filaments cannot be pulled apart without breaking at least in part the structure of the multi-filament yarn, said bridges being made of the same material as said filaments, some of the segments of individual filaments between two consecutive interfilamentary bridges being of different length.

2. A yarn according to claim 1 wherein said cohered filaments comprise at least in part helical filaments bonded at at least some points of contact to essentially straight filaments.

3. A yarn according to claim 1 in the form of a staple yarn.

4. A staple yarn according to claim 3 wherein one end of a portion of the cohered filament is positioned along the axis of said yarn and the other end is positioned transverse to the axis of said yarn.

5. A garment or fabric comprising the yarn of claim 4.

6. A staple yarn according to claim 3 wherein at least some of the cohered filaments have at least one of their end portions positioned transverse to the axis of said yarn.

7. A textile yarn according to claim 1 wherein said cohered filaments comprise at least in part textured filaments.

8. A textile yarn according to claim 7 wherein the textured filaments are crimped filaments.

9. A textile yarn according to claim 7 wherein the textured filaments are at least in part helical.

10. A textile yarn according to claim 1 wherein said cohered filaments have a trunk of molecularly oriented material.

11. A yarn according to claim 1 wherein said cohered filaments comprise straight filaments joined to textured filaments by interfilamental bridges.

12. A yarn according to claim 11 wherein the textured filaments are wavy.

13. A fabric comprising the yarn of claim 12.

14. A textile yarn according to claim 1 wherein said cohered filaments differ in texture from one another.

15. A yarn according to claim 1 wherein the cohered filaments have beads on the trunk of said filaments, the said beads comprising a multiplicity of voids.

16. A yarn according to claim 1 wherein at least a part of said cohered filaments have a main trunk of molecularly oriented material and integral therewith small sections comprising at least partially disoriented material.

17. A yarn according to claim 1 wherein said cohered filaments comprise at least in part filaments with thickened end portions on the trunk of said filaments.

18. A garment or fabric comprising yarns according to claim 1.

* * * * *